US005669762A

United States Patent [19]

Lee

[11] Patent Number: 5,669,762

[45] Date of Patent: Sep. 23, 1997

[54] SOUND AND PULSATION REDUCING OUTLET CHAMBER FOR AN AIR COMPRESSOR

[75] Inventor: Daniel Lee, Taipei, Taiwan

[73] Assignee: Apex Medical Corp., Taipei, Taiwan

[21] Appl. No.: 686,027

[22] Filed: Jul. 25, 1996

[51] Int. Cl.[6] ..... F04B 39/12

[52] U.S. Cl. ..... 417/312; 417/540; 181/269; 181/274

[58] Field of Search ..... 417/312, 540, 417/413.1; 5/713; 181/264, 269, 274

[56] References Cited

U.S. PATENT DOCUMENTS

| | | | |
|---|---|---|---|
| 2,239,549 | 4/1941 | Chipley | 181/269 |
| 3,838,944 | 10/1974 | Kolfertz | 417/312 |
| 5,137,432 | 8/1992 | Tsai | 417/312 |
| 5,407,330 | 4/1995 | Rimington et al. | 417/312 |

FOREIGN PATENT DOCUMENTS

| | | | |
|---|---|---|---|
| 852518 | 10/1938 | France | 181/57 |
| 247773 | 10/1989 | Japan | 417/312 |

*Primary Examiner*—Roland McAndrews
*Attorney, Agent, or Firm*—Bacon & Thoams

[57] ABSTRACT

An air chamber structure for a medical air compressor, the chamber being provided between the pump and an air bed. Two flow guiding stubs are provided at an air input end to scatter air and render it to revolve in a storage chamber with a smaller space, the air is led into a larger pressure stabilizing chamber through a flow guiding port during continuous pumping of air into the storage chamber, and hence the output of the air can be stable and at a constant flow rate. An air output pipe is located on one edge opposite to the storage chamber, and air is uniformly spread in the pressure stabilizing chamber, and is put out from the output pipe at a constant flow rate, thus avoiding the disadvantage of generating resonance and wind noise in the inflated bed.

1 Claim, 3 Drawing Sheets

SOUND AND PULSATION REDUCING OUTLET CHAMBER FOR AN AIR COMPRESSOR

BACKGROUND OF THE INVENTION

1. Field of the Invention

The present invention relates to improvement of a medical instrument, and especially to the structure of an air chamber for a medical air compressor. It takes advantage of a plurality of flow guiding stubs provided in an air input end to scatter air and render it to revolve in a storage chamber with smaller space, the air is led into a larger pressure stabilizing chamber through a flow guiding port, so that output of the air can be stable and have constant flow rate.

2. Description of the Prior Art

A patient having a serious injury or unable to move and lying on a bed without turning over is subjected to abscess due to sphaceloderma that is induced by loss of stop of blood circulation. A doctor or a nurse hence is required to turn the patient over to change to another posture periodically. This requires frequent procedures by the doctor or the nurse to suffer too much. Therefore, an aerator such as an air bed is used for this procedure. An air bed is filled with air, and a set of balls lined in a plurality of parallel series are provided therein for alternately raising and lowering the patient. The raising portion can elevate the body of a patient, while the lowering portion can maintain a distance from the body to provide air convection. This also provides a massaging effect, so the back of the patient can be prevented from lengthy contact with the bed, thus thus sphaceloderma can be prevented. The conventional medical air compressor is provided therebeneath with a pump chamber composed of upper and lower housing portions A, B (referring to FIG. 4), the pump chamber is mounted with a trifurcated guide tube 1, wherein, two ends thereof are input pipes 11, while the other end is an output pipe 12, the input pipes 11 and the output pipe 12 are connected to a pressure chamber 2 of the compressor and an air bed (not shown). After the synchronous motor 2 indirectly pumps air through the input pipes 11 and the output pipe 12 into the air bed, two set of balls in the air bed are alternately raised and lowered, so resistance to the air rushing in the air bed creates resonance and wind noise and causes the patient to feel as if he is lying on an electronic vibrator. This is a bad situation for the emotional well being of the patient.

SUMMARY OF THE INVENTION

The present invention overcomes the above stated disadvantage, and hence provides an air chamber structure for a medical air compressor wherein the air chamber structure is composed of upper and lower housing portions which form a peripherally sealed space with a storage chamber provided therein. The storage chamber has therein flow guiding stubs (with a flow guiding port provided by them) at the location corresponding to that of the input pipes of the upper housing portion. An output pipe is extended out from the location on one edge of the lower housing portion and positioned opposite to the storage chamber. A smaller space confined by the storage chamber is within the larger space confined by a pressure stabilizing chamber formed by the closely connected upper and lower housing portions, thus realizing the natural principle of air spreading from a smaller space to a larger space.

The principal object of the present invention is to provide an air chamber structure for a medical pump, and takes advantage of a plurality of flow guiding stubs to scatter air flowing in through the input pipes, with the air being led into a pressure stabilizing chamber through the flow guiding port on the lateral side of the storage chamber.

Air can be uniformly spread in the pressure stabilizing chamber, and can be put out stably and with a constant flow rate, so the disadvantage of generating resonance and wind noise in the inflated bed can be avoided.

The present invention will be apparent in its practical structure, characteristics and functions from the detailed description of the preferred embodiment thereof in reference to the accompanying drawings.

DETAILED DESCRIPTION OF THE PREFERRED EMBODIMENT

Figure 1:
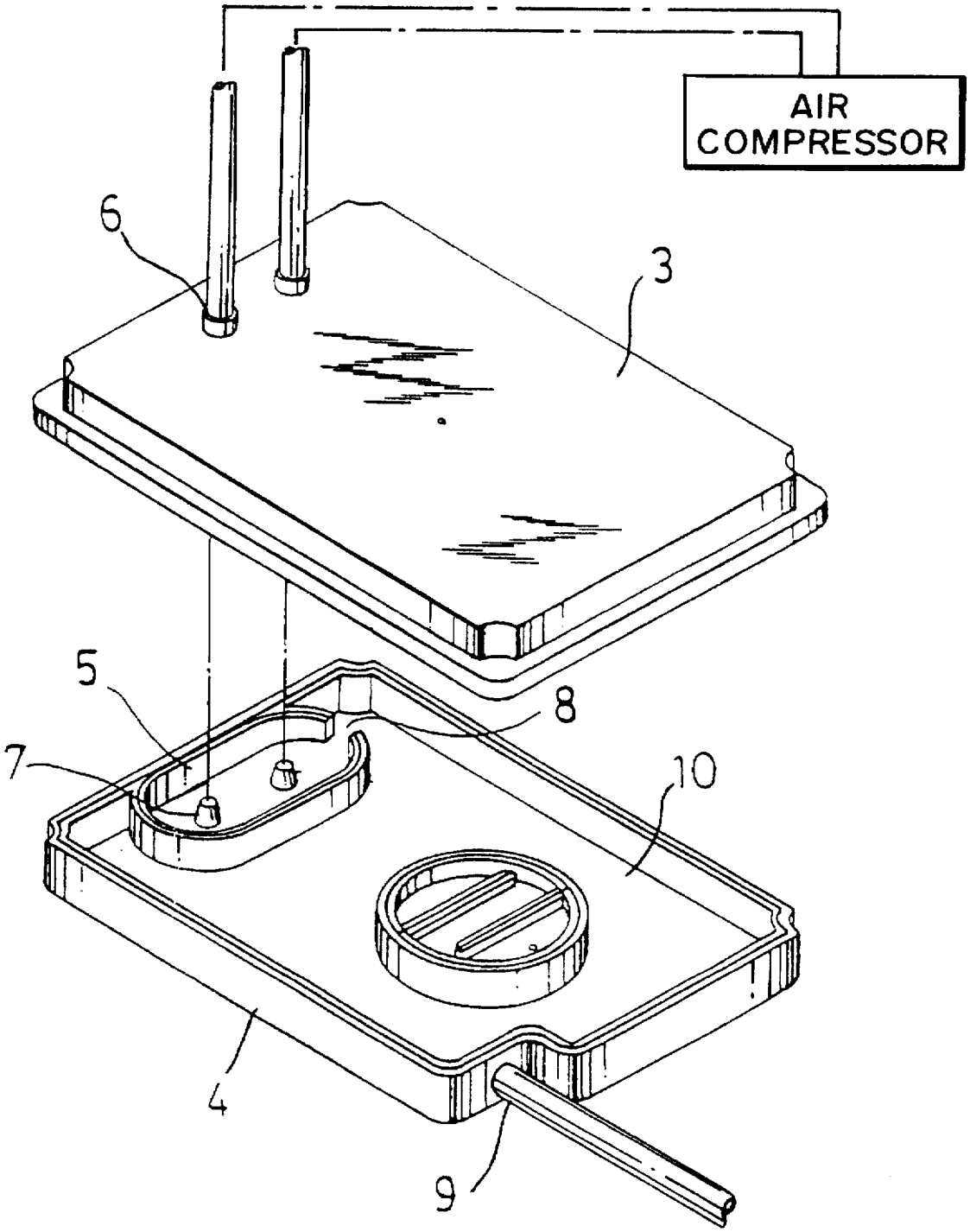
FIG. 1 is a perspective view of the structure of the present invention.
Figure 2:
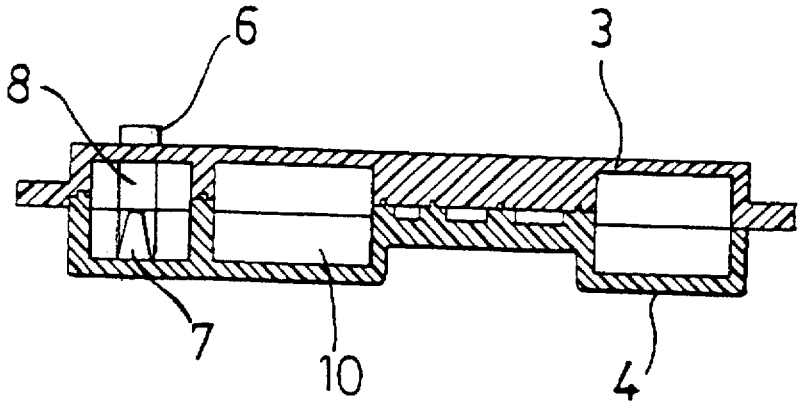
FIG. 2 is a sectional side view of the completely closed and sealed upper and lower housings of the present invention.

It can be clearly seen from FIG. 1 that, the structure of a medical air compressor of the present invention is provided between the compressor and the inflated article to be (such as an air bed), and is comprised of an upper and a lower housing portions 3, 4, with the upper and the lower housing portions 3, 4 each having therein and inside the same end thereof a storage chamber wall 5 in the same height as that of the protruding edges of the the upper and the lower housing portion 3, 4 respectively. The upper housing portion 3 is provided with two input pipes 6 connecting to the exterior at the locations within the storage chamber wall 5, while the lower housing portion 4 is provided with two flow guiding stubs 7 at the locations corresponding to those of the two input pipes 6. A flow guiding port 8 is provided at one lateral side of the storage chamber walls 5 of each of the housing portions 3, 4, an output pipe 9 is extended out from the location on one edge of the lower housing portion 4 and positioned opposite to its storage chamber wall 5. When the upper and the lower housing portions 3, 4 are closed and recurred together, the periphery of the housing 3, 4 are sealed completely except for the two input pipes 6 and the output pipe 9. The smaller space formed by the storage chamber walls 5 is independently located within the larger space of a pressure stabilizing chamber 10 that is formed when the upper and the lower housing portions 3, 4 are tightly closed. The two input pipes 6 and the output pipe 9 are connected respectively to the motor and the article to be inflated, while the input pipes 6 are exactly coaxial with the two flow guiding stubs 7 respectively.

Figure 3:
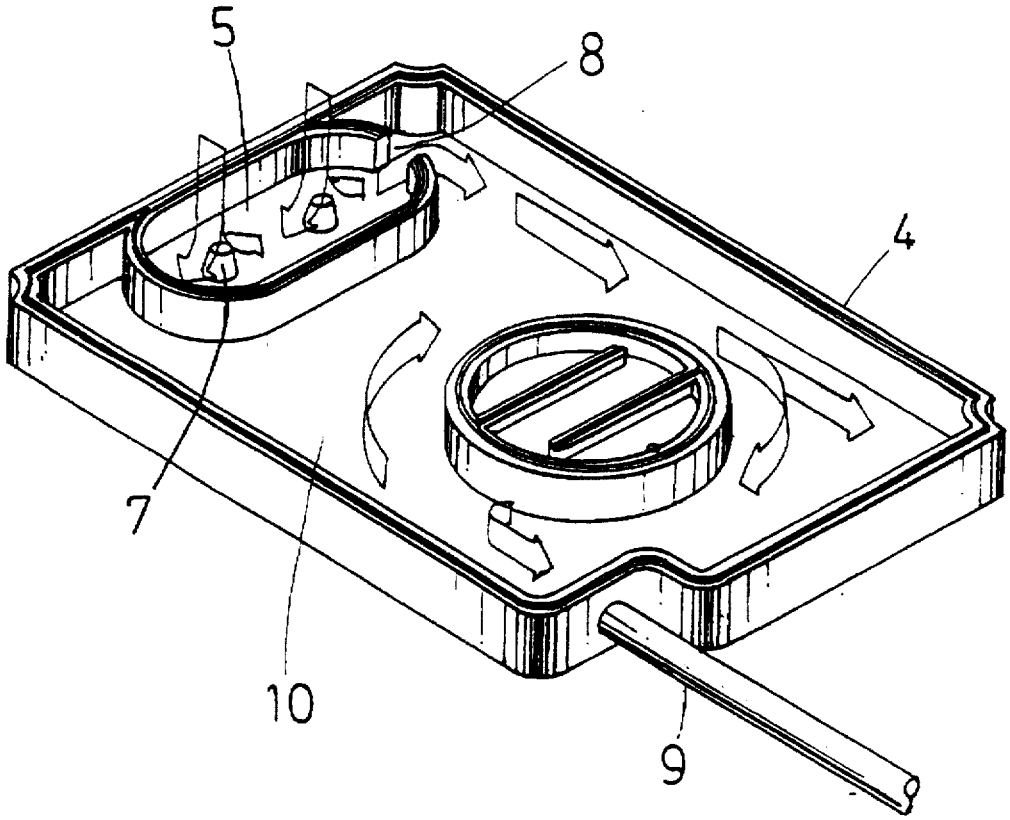
FIG. 3 is a schematic view showing flowing directions of air flowing in through the input pipes in the present invention.
Figure 4:
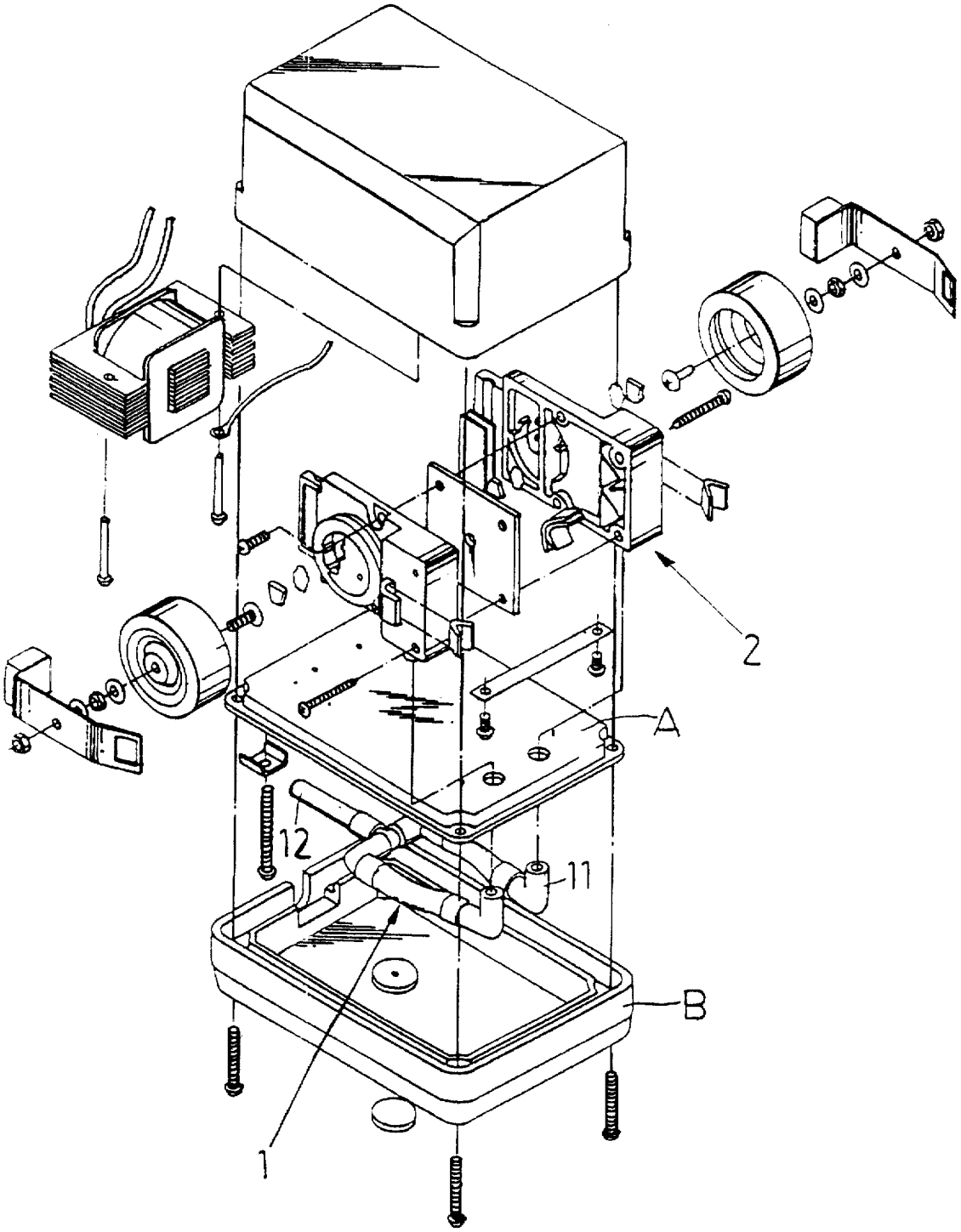
Fig. 4 PRIOR ART
FIG. 4 is an exploded perspective view of the structure of a conventional medical pump.

When air is alternately pumped into the air chamber through the two input pipes 6, it will rush directly to the two flow guiding stubs 7 in the storage chamber walls 5, and is scattered by the flow guiding stubs 7 and is buffered (referring to FIG. 3), the scattered air will be revolved in the storage chamber formed by the storage chamber walls 5, and the storage chamber is used for stabilizing and rectifying the air flow. And during continuous pumping of air into the storage chamber through the input pipes 6 and revolving in the storage chamber, air is led from the storage chamber through the flow guiding port 8 provided at one lateral side of the storage chamber into the pressure stabilizing chamber 10 with a larger space (referring to the arrows in FIG. 3), and is uniformly spread, revolving and so finally air from the output pipe 9 can be stable and have a constant flow rate. Therefore, raising and lowering of the inflated article can be very gentle, and no resonance or wind noise will be created, and a massaging effect can be provided. The body of a patient can be prevented from a tight and lengthy contact with the air bed, and thus sphaceloderma can be prevented.

Having now particularly described and ascertained the nature of the invention and in what manner the same is to be operated, what is claimed is:

1. An air chamber structure for a medical air compressor comprising:

(a) an upper housing portion including a protruding edge, a storage chamber wall disposed within the upper housing portion at one end thereof, the protruding edge and the storage chamber wall being of substantially the same height, a pair of input pipes for connecting the storage chamber to a pressure chamber of a compressor, and a first flow guiding port provided at a lateral side of the storage chamber wall;

(b) a lower housing portion including a protruding edge, a second storage chamber wall disposed within the lower housing portion adjacent an end thereof, the protruding edge and the second storage chamber wall being of substantially the same height, a bottom wall, a pair of flow guiding stubs provided on the bottom wall within the second storage chamber wall, the flow guiding stubs corresponding in location to the input pipes of the upper housing portion, a second guiding port at one lateral side of the second storage chamber wall, an output pipe extending from the lower housing portion at a location opposite to the second storage chamber wall for connection to a medical article to be inflated; and (c) wherein when the upper and lower housing portions are secured together along their protruding edges, a pressure stabilizing chamber is formed therebetween and the first and second storage chamber walls form an independent storage chamber disposed within the pressure stabilizing chamber so that when air is alternately pumped into the storage chamber through the pair of input pipes, the air is scattered by the flow guiding stubs and is uniformly spread within the pressure stabilizing chamber and thereafter distributed through the output pipe at a constant flow rate.

* * * * *